United States Patent [19]

Stanley et al.

[11] Patent Number: 4,760,812

[45] Date of Patent: Aug. 2, 1988

[54] MINIATURE PULLEY BLOCK ASSEMBLY

[75] Inventors: Larry Stanley, Kailua, Hi.; Frank Tidswell, Santa Barbara, Calif.

[73] Assignee: Mainland Windsurfing Hawaii, Inc., Goleta, Calif.

[21] Appl. No.: 90,853

[22] Filed: Aug. 31, 1987

[51] Int. Cl.[4] ..... B63H 9/04

[52] U.S. Cl. ..... 114/108; 114/39.1; 114/102; 114/218

[58] Field of Search ..... 114/39.1, 39.2, 102, 114/103, 104, 108, 218

[56] References Cited

U.S. PATENT DOCUMENTS

| | | | |
|---|---|---|---|
| 4,365,570 | 12/1982 | Jamieson | 114/108 |
| 4,436,047 | 3/1984 | Freyrie | 114/102 |

FOREIGN PATENT DOCUMENTS

| | | | |
|---|---|---|---|
| 0071253 | 2/1983 | European Pat. Off. | 114/102 |
| 2556311 | 6/1985 | France | 114/108 |

*Primary Examiner*—Sherman D. Basinger
*Assistant Examiner*—Jesûs D. Sotelo
*Attorney, Agent, or Firm*—Donald A. Streck

[57] ABSTRACT

A pulley block system for releasable attachment to a sheet end and requiring no overhang beyond the sheet end. There is a first pulley block assembly having planar, parallel, spaced side portions and including a first pulley roller rotatably mounted between the side portions of the first pulley block assembly so that a line can pass over the first pulley roller. There is also a second pulley block assembly having planar, parallel, spaced side portions and including a second pulley roller rotatably mounted between the side portions of the second pulley block assembly so that a line can pass over the second pulley roller; and, interlocking apparatus for passing through the sheet to releasably interconnect the first and second pulley block assemblies with the sheet attached to and between the first and second pulley block assemblies. The preferred interlocking apparatus comprises a shaft extending outward perpendicular to one of the side portions of the first pulley block assembly and a bore through the second pulley block assembly perpendicular to the side portions thereof for receiving the shaft. In the preferred embodiment, the shaft has a T-shaped end comprised of opposed ears extending perpendicularly outward at the end of the shaft and the bore is disposed in a web portion of the second pulley block assembly and has at least one radial slot for the ears to pass through.

22 Claims, 2 Drawing Sheets

MINIATURE PULLEY BLOCK ASSEMBLY

BACKGROUND OF THE INVENTION

The present invention relates to pulleys and, more particularly, to a pulley block assembly for releasable attachment to a sheet end and requiring no overhang beyond the sheet end comprising, a first pulley block housing having planar, parallel, spaced side portions and including a first half of interconnection means for releasably interconnecting the first pulley block housing in side-by-side parallel relationship to a second pulley block housing; a first pulley roller rotatably mounted between the side portions of the first housing so that a line can pass over the first pulley roller; a second pulley block housing having planar, parallel, spaced side portions and including a mating second half of the interconnection means disposed for interconnecting the first and second pulley block housings, the interconnection means including interconnecting means for attaching the sheet to and between the first and second pulley blocks; and, a second pulley roller rotatably mounted between the side portions of the second housing so that a line can pass over the second pulley roller.

Windsurfing has become a highly popular and competitive sport within recent years. As with most competitive sports, competition equipment is highly refined to provide peak performance. A basic sailboard is shown in FIG. 1 wherein it is generally indicated as 10. Sailboard 10 comprises a board 12 upon which the sailor stands. A mast 14 extends upward from the board 12 and a boom 16, as shown enlarged in FIG. 2 in top view, extends backward from the mast 14. Unlike a sailboat where the boom is a single member under which the occupant sits, the boom 16 of the sailboard 10 is gripped by the sailor in a standing position. A sail 18 extends from the mast to the rear of the boom 16 with its clew located generally in the area indicated as 20. As can be seen, it is popular and convenient to have the boom 16 of a "wishbone" shape with gripping arms 22 on either side of the sail 18. As the sailor changes direction, he or she can swing in front of the mast 14 to stand on the proper side of the board 12 relative to the wind position and grip the appropriate arm 22.

Sail performance is enhanced by having the clew 20 of the sail 18 extend all the way to the end of the boom 16. Employing prior art methods and apparatus for adjustably attaching the clew 20 to the boom 16 has required sailors to choose from the following non-ideal situations. The outhaul line could be reeved directly through a grommet in the sail at the clew, which allow the sail to be pulled to the boom end; but, creates high friction, which makes it difficult to place adequate tension on the sail. Additionally, that approach requires that the line be reeved through the sail grommet each time the sail is rigged or changed, which is tedious and time consuming. A pulley system can be attached permanently to the sail clew. This allows the sail to be pulled to the end and reduces friction; but, as in the previous approach, requires that the outhaul be reeved each time the sail is rigged or changed. Finally, one could use a pulley/hook combination as is known in the prior art; but, which increases the gap between the sail and boom end to up to two inches.

The typical prior art pulley arrangement is depicted in simplified form in FIG. 2. A first pulley 26 is attached to the clew 20 of the sail 18, either permanently or with a releasable hook arrangement, and a second pulley 28 is attached to the end of the boom. The two pulleys 26, 28 are reeved with line 30 as appropriate for the particular configuration whereby the outhaul of the line 30 can be pulled in the direction of arrow 32 to pull the sail 18 taut. Such prior art apparatus for adjustably connecting the sail 18 to the boom 16 is large and cumbersome. Moreover, sailboards are generally disassembled when carried on cartop roof racks, and the like, and, therefore, the ability to easily disassemble the interconnections between the parts is an important consideration. In the prior art, not only are the boom-to-sail connections large and cumbersome, they are also typically complex and not easily disassembled.

A more detailed understanding of the problem to which the present invention is directed can be seen, for example, with reference to U.S. Pat. No. 4,365,570 of Jamieson; U.S. Pat. No. 31,167 of Schweitzer, et al.; U.S. Pat. No. 4,436,047 of Freyrie; European Pat. No. 0 071 253 of Brittinger and European Pat. No. 0 021 447 of Nieschler.

What is desirable is an apparatus which combines low friction, virtually no gap between the clew and boom, and quick attachment and detachment without the necessity for rethreading of lines each time.

Wherefore, it is the object of the present invention to provide a miniature pulley block assembly for attaching a sail to the end of a boom in a minimum distance.

It is another object of the present invention to provide a miniature pulley block assembly for a sailboard wherein the components thereof are releasable from one another whereby the sail is easily disassembled from the boom end.

Other objects and benefits of the present invention will become apparent from the detailed description contained hereinafter taken in conjunction with the drawing figures which accompany it.

SUMMARY

The foregoing objects have been achieved by the close clearance, miniature pulley block assembly of the present invention for adjustably and releasably attaching a sail to a boom end comprising, a first U-shaped pulley block housing having planar, parallel, spaced side portions and including a first half of interconnection means for releasably interconnecting the first pulley block housing in side-by-side parallel relationship to a second U-shaped pulley block housing; a first pulley roller rotatably mounted between the side portions of the first housing so that a line can pass over the first pulley roller between the first pulley roller and the closed end of the U-shape; a second U-shaped pulley block housing having planar, parallel, spaced side portions and including a mating second half of the interconnection means disposed for interconnecting the first and second pulley block housings with the open ends of the U-shapes facing in substantially the same direction, the interconnection means including an interconnecting member which can be passed through the sail to attach the sail to and between the first and second pulley block housings; and, a second pulley rocker rotatably mounted between the side portions of the second pulley block housing so that a line can pass over the second pulley roller between the second pulley roller and the closed end of the U-shape.

In the preferred embodiment, the first half of the interconnection means comprises a shaft extending outward perpendicular to one of the side portions of the first housing, the shaft being the interconnecting member while the second half comprises a bore through the second housing perpendicular to the side portions thereof for receiving the shaft. The preferred shaft includes means for releasably maintaining the shaft within the bore. More particularly, the shaft has a T-shaped end comprised of opposed ears extending perpendicularly outward at the end of the shaft and the bore is disposed in a web portion of the second housing and has at least one radial slot for the ears to pass through.

DESCRIPTION OF THE PREFERRED EMBODIMENT

Figure 2:
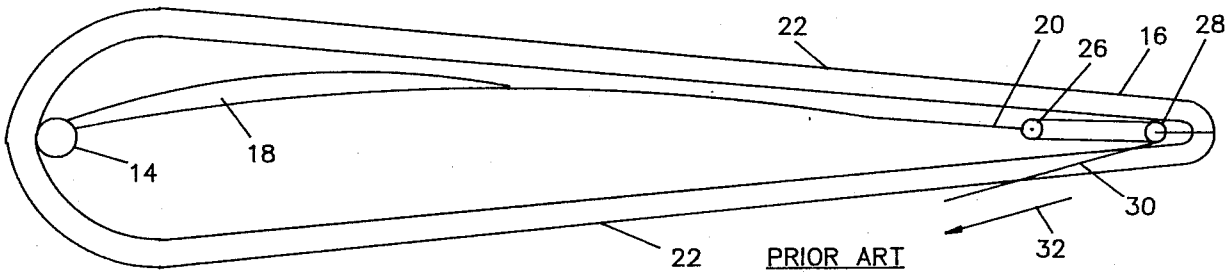
PRIOR ART FIG. 2
FIG. 2 is a top view of the boom of the sailboard of FIG. 1 showing the environment as wherein the present invention is applicable.
Figure 5:
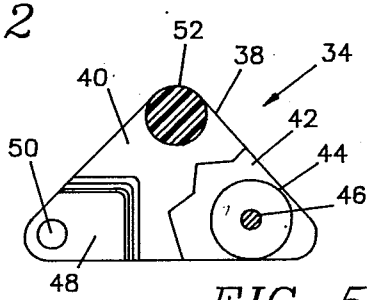
FIG. 5 is a partially cutaway view of FIG. 3.
Figure 7:
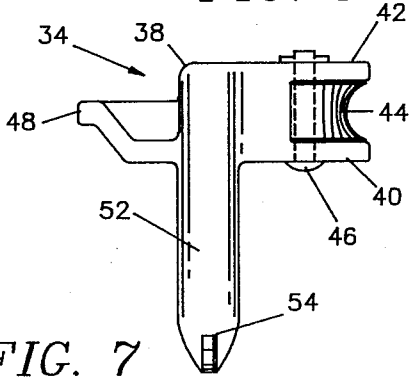
FIG. 7 is a top view of the first pulley block.
Figure 4:
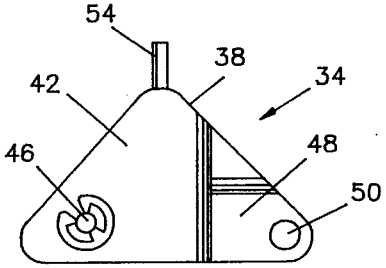
FIG. 4 is a right side view of the first pulley block.
Figure 6:
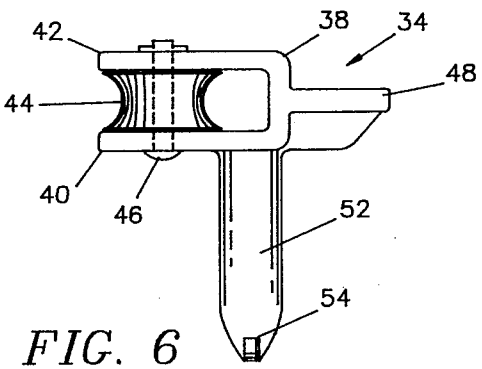
FIG. 6 is a bottom view of the first pulley block.
Figure 1:
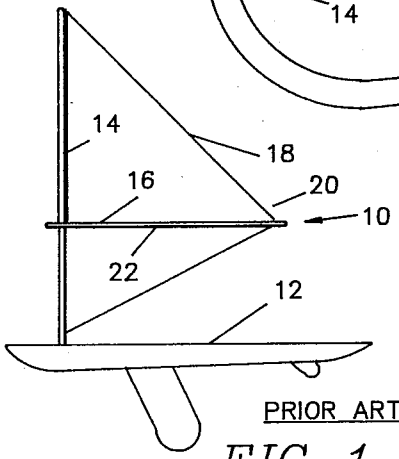
PRIOR ART FIG. 1
FIG. 1 is a simplified side view of a sailboard.
Figure 3:
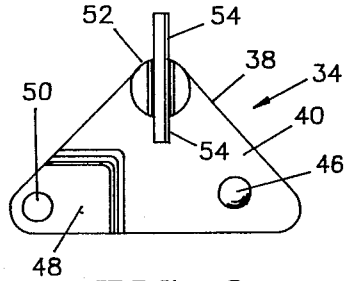
FIG. 3 is a left side view of the first pulley block of the present invention.

The present invention is a miniature pulley block assembly providing two pulley rollers over which a line can be reeved to corresponding pulley rollers on the boom end for drawing the sail tight with a strong mechanical advantage. Each pulley roller is contained in a separate piece and the two pieces are easily assemblable and disassemblable in an interlocking side-by-side relationship with one another. There is an interconnecting member between the two pieces which is passed through a grommet, or the like, in the clew of the sail to releasably attach the miniature pulley block assembly to the tip of the sail adjacent the sides thereof so that no overhang is produced. The first pulley block as intended for attachment to the sail 18 is shown in FIGS. 3–7 wherein it is generally indicated as 34. The second pulley block is shown in FIGS. 8–12 wherein it is generally indicated as 36. As those skilled in the art will recognize, while the present invention is intended primarily for the described use of attaching a sail to a boom end, the unique advantages thereof can be of benefit to other applications requiring a low overhang pulley block system and/or a removable pulley block system. The advantages could also be realized in a non-miniature version for larger applications such as with larger sails, tents, etc. Accordingly, it is applicants' intent that the specific application described herein not be limiting and that the description and claims appended thereto be accorded a breadth in keeping with the scope and spirit of the present invention.

Turning first to FIGS. 3–7, the first pulley block 34 comprises a housing 38 having planar, parallel, spaced side portions 40 and 42. A pulley roller 44 is rotatably mounted on a shaft 46 between the two side portions 40, 42. The housing 38 is generally U-shaped and has a web 48 extending outward from the closed end of the U and parallel to the side portions 40, 42. There is a bore 50 through the web 48 by means of which the outhaul line can be attached to the first pulley block 34 in a manner to be described hereinafter. Preferred construction is to have the pulley roller 44 and shaft 46 of metal such as stainless steel and/or brass as useful around saltwater without corrosion and the remaining portions of one of the high strength plastics available and known in the art. Other materials known in the art could, of course, be used if desired. A shaft 52 extends outward from side portion 40 perpendicular thereto. Shaft 52 is cylindrical in cross-section and has a generally T-shaped tip formed by small ears or extensions 54. As will be seen shortly, the shaft 52 is an interconnecting member employed to interlock the two pulley blocks together and attach them to a sail, or other sheet, by passing therethrough to position the pulley blocks on either side thereof.

Turning now to FIGS. 8–12, it can be seen therein that the second pulley block 36 also has a housing 56 of generally U-shape and with parallel side portions 58, 60. Again, there is a pulley roller 62 rotatably mounted on a shaft 64 between the side portions 58, 60. In the second pulley block 36, side portion 60 extends beyond the U-shaped portion of housing 56 to form a thickened web 66. The web 66 has a bore 68 therethrough sized as a clearance fit to the shaft 64. Bore 68 also has opposed radial slots 70 therein through which the extensions 54 can pass when assembling and disassembling the pulley blocks 34, 36. The manner of assembly and use of the present invention will now be described in detail.

Figure 13:
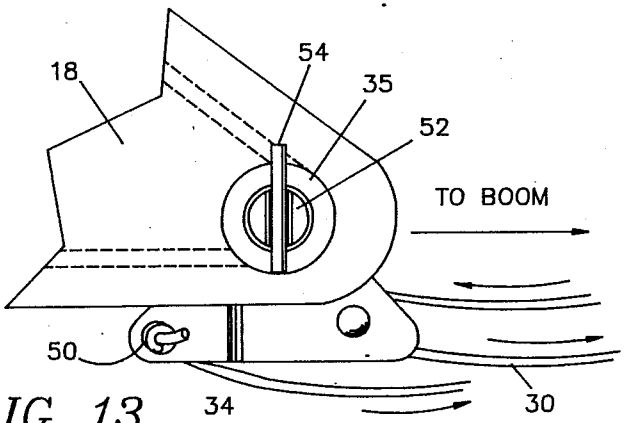
FIG. 13–14 shows the manner in which the first and second pulley blocks are releasably connected to the sail clew.
Figure 14:
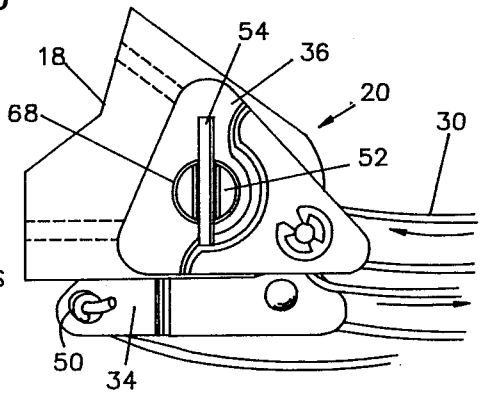
Figure 9:
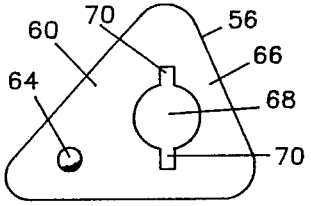
FIG. 9 is a right side view of the second pulley block.
Figure 11:
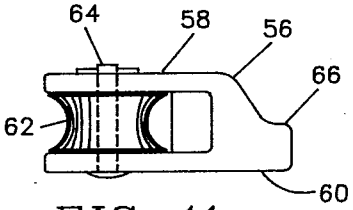
FIG. 11 is a top view of the second pulley block.
Figure 15:
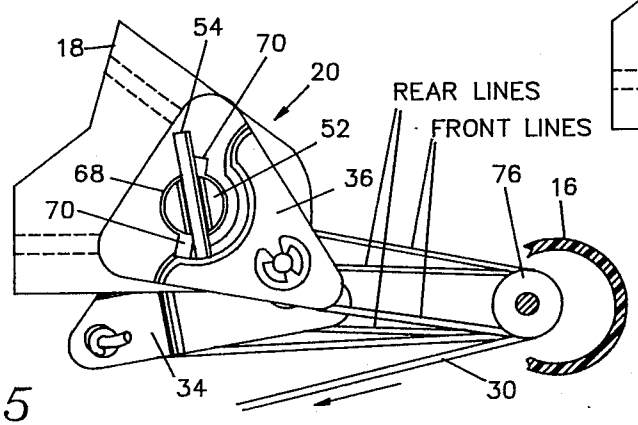
FIG. 15 shows the miniature pulley block assembly of the present invention fully attached to the sail and reeved to the boom end.
Figure 8:
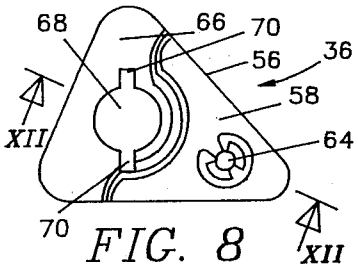
FIG. 8 is a left side view of the second pulley block of the present invention.
Figure 10:
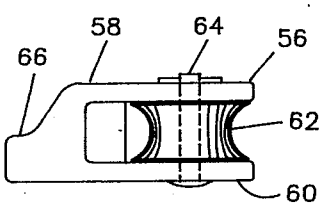
FIG. 10 is a bottom view of the second pulley block.
Figure 12:
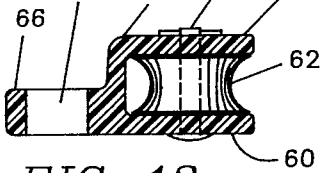
FIG. 12 is a cutaway view through the second pulley block in the plane XII—XII of FIG. 8.

Turning first to FIG. 13, the first pulley block 34 is intended to be attached to the clew 20 of the sail by passing the interconnecting shaft 52 through a grommet 35 provided for the purpose. The second pulley block 36 is then attached to the first pulley block 34 by inserting the shaft 64 through the bore 68 as shown in FIG. 14. This places the blocks 34, 36 in an interlocked side-by-side relationship with the clew 20 disposed between them and attached to the shaft 52 passing through the grommet 35. Note that there need be no overhang of the blocks 34, 36 beyond the tip of the clew 20. The slight overhand depicted in the drawing figures is for convenience of visualization only. As those skilled in the art will recognize, while the shaft 52 is provided with a T-shaped end to provide locking interconnectability between the shaft 52 and bore 68, other methods for releasably connecting the shaft 52 within the bore 68 could be employed within the scope and spirit of the present invention. The design as shown herein is preferred since it is of unitary construction and, therefore, there are no parts to be lost and manufacture is simple and inexpensive. Other methods of interlocking the blocks 34, 36 through the clew 20 could also be employed within the scope and spirit of the present invention as will be recognized by those skilled in the art. As will be noted, in the preferred embodiment as depicted in the drawings, one of the extension ears 54 is slightly longer than the other. To interconnect the first and second pulley blocks 34, 36, the longer extension 54 is passed through the bore 68 by tipping the second pulley block 36. The second pulley block 36 is then rotated about the end of the shaft 52 causing the shorter extension 54 to pass through the lower slot 70 as the figure is viewed. It will be noted that as thus assembled, the first and second pulley blocks 34, 36 are slightly offset from one another. An outhaul line 30 is attached to the block 34 by passing it through the bore 50 and knotting its end to prevent its passing back through the bore 50. The remainder of the outhaul line is reeved through the pulley rollers 44, 62 and corresponding pulley rollers 76 provided in the end of the boom 16 for the purpose. The pulley rollers 76 can be mounted to the outside of the boom 16 or, for minimization of the space occupied, can be incorporated into the end of the boom 16 as shown in FIG. 15. When completely reeved through the pulley rollers 44, 62, and 76, and pulled taut, the line 30 causes the pulley rollers 44, 62 to pull into alignment thereby rotating the second pulley block 36 slightly clockwise about the shaft 52 and placing the extensions 54 out of alignment with the slots 70 whereby the second pulley block 36 cannot come off of the shaft 52 in use. As should be appreciated, the blocks 34, 36 can be interconnected as described above and can be disconnected from one another and released from the sail without the necessity of unreeving the outhaul line 30 once it has been reeved.

Thus, it can be seen that the present invention has met its stated objectives by providing a miniature pulley block assembly which is assemblable and disassemblable for use and storage and which occupies no overhang area between the tip of the sail and the end of the boom.

Wherefore, having thus described our invention, we claim:

1. A pulley block assembly for releasable attachment to a sheet end and requiring no overhang beyond the sheet end comprising:

(a) a first pulley block housing having planar, parallel, spaced side portions and including a first half of interconnection means for releasably interconnecting said first pulley block housing in side-by-side parallel relationship to a second pulley block housing;

(b) a first pulley roller rotatably mounted between said side portions of said first housing so that a line can pass over said first pulley roller;

(c) a second pulley block housing having planar, parallel, spaced side portions and including a mating second half of said interconnection means disposed for interconnecting said first and second pulley block housings, said interconnection means including interconnecting means for attaching the sheet to and between said first and second pulley blocks; and, (d) a second pulley roller rotatably mounted between said side portions of said second housing so that a line can pass over said second pulley roller.

2. The pulley block assembly of claim 1 wherein:

(a) said first half comprises a shaft extending outward perpendicular to one of said side portions of said first housing, said shaft being said interconnecting means; and, (b) said second half comprises a bore through said second housing perpendicular to said side portions thereof for receiving said shaft.

3. The pulley block assembly of claim 2 wherein:

said shaft includes means for releasably maintaining said shaft within said bore.

4. The pulley block assembly of claim 2 wherein:

(a) said shaft has a T-shaped end comprised of opposed ears extending perpendicularly outward at the end of said shaft; and, (b) said bore is disposed in a web portion of said second housing and has at least one radial slot for said ears to pass through.

5. The pulley block assembly of claim 4 wherein:

said shaft has a rounded end and one of said ears is longer than the other whereby said shaft is insertable into said bore only by first inserting the longer of said ears through said bore and thereafter rotating said shaft about the longer ear as a pivot point to thereby rotate said rounded end and the shorter ear through said bore and said slot.

6. The pulley block assembly of claim 4 wherein:

said web portion lies in a plane containing one of said side portions of said second housing.

7. The pulley block assembly of claim 1 wherein:

said first pulley block housing includes a web portion lying in a plane parallel to and between said side portions of said first housing and containing a bore therethrough by means of which the free end of a line to be reeved through said first and second pulley rollers can be attached to said first pulley block housing.

8. A close clearance, miniature pulley block assembly for adjustably and releasably attaching a sail to a boom end comprising:

(a) a first U-shaped pulley block housing having planar, parallel, spaced side portions and including a first half of interconnection means for releasably interconnecting said first pulley block housing in side-by-side parallel relationship to a second U-shaped pulley block housing;

(b) a first pulley roller rotatably mounted between said side portions of said first housing so that a line can pass over said first pulley roller between said first pulley roller and the closed end of the U-shape;

(c) a second U-shaped pulley block housing having planar, parallel, spaced side portions and including a mating second half of said interconnection means disposed for interconnecting said first and second pulley block housings with the open ends of the U-shapes facing in substantially the same direction, said interconnection means including an interconnecting member which can be passed through the sail to attach the sail to and between said first and second pulley block housings; and, (d) a second pulley roller rotatably mounted between said side portions of said second pulley block housing so that a line can pass over said second pulley roller between said second pulley roller and the closed end of the U-shape.

9. The miniature pulley block assembly of claim 8 wherein:

(a) said first half comprises a shaft extending outward perpendicular to one of said side portions of said first housing, said shaft being said interconnecting member; and, (b) said second half comprises a bore through said second housing perpendicular to said side portions thereof for receiving said shaft.

10. The miniature pulley block assembly of claim 9 wherein:

said shaft includes means for releasably maintaining said shaft within said bore.

11. The miniature pulley block assembly of claim 9 wherein:

(a) said shaft has a T-shaped end comprised of opposed ears extending perpendicularly outward at the end of said shaft; and, (b) said bore is disposed in a web portion of said second housing and has at least one radial slot for said ears to pass through.

12. The miniature pulley block assembly of claim 11 wherein:

said shaft has a rounded end and one of said ears is longer than the other whereby said shaft is insertable into said bore only by first inserting the longer of said ears through said bore and thereafter rotating said shaft about the longer ear as a pivot point to thereby rotate said rounded end and the shorter ear through said bore and said slot.

13. The miniature pulley block assembly of claim 11 wherein:

said web portion lies in a plane containing one of said side portions of said second housing.

14. The miniature pulley block assembly of claim 8 wherein:

said first pulley block housing includes a web portion lying in a plane parallel to and between said side portions of said first pulley block housing and containing a bore therethrough by means of which the free end of a line to be reeved through said first and second pulley rollers can be attached to said first pulley block housing.

15. A pulley block system for releasable attachment to a sheet end and requiring no overhang beyond the sheet end comprising:

(a) a first pulley block assembly having planar, parallel, spaced side portions and including a first pulley roller rotatably mounted between said side portions of said first pulley block assembly so that a line can pass over said first pulley roller;

(b) a second pulley block assembly having planar, parallel, spaced side portions and including a second pulley roller rotatably mounted between said side portions of said second pulley block assembly so that a line can pass over said second pulley roller; and, (c) interlocking means for passing through the sheet to releasably interconnect said first and second pulley block assemblies with the sheet attached to and between said first and second pulley block assemblies.

16. The pulley block system of claim 15 wherein said interlocking means comprises:

(a) a first half of interconnection means for releasably interconnecting said first pulley block assembly in side-by-side parallel relationship to said second pulley block assembly carried by said first pulley block assembly; and, (b) a mating second half of said interconnection means disposed for interconnecting said first and second pulley block assemblies carried by said second pulley block assembly, said interconnection means including an interconnecting member which can be passed through the sheet to attach the sheet to and between said first and second pulley block assemblies.

17. The pulley block system of claim 16 wherein:

(a) said first half comprises a shaft extending outward perpendicular to one of said side portions of said first pulley block assembly, said shaft being said interconnecting member; and, (b) said second half comprises a bore through said second pulley block assembly perpendicular to said side portions thereof for receiving said shaft.

18. The pulley block system of claim 17 wherein:

said shaft includes means for releasably maintaining said shaft within said bore.

19. The pulley block system of claim 17 wherein:

(a) said shaft has a T-shaped end comprised of opposed ears extending perpendicularly outward at the end of said shaft; and, (b) said bore is disposed in a web portion of said second pulley block assembly and has at least one radial slot for said ears to pass through.

20. The pulley block system of claim 19 wherein:

said shaft has a rounded end and one of said ears is longer than the other whereby said shaft is insertable into said bore only by first inserting the longer of said ears through said bore and thereafter rotating said shaft about the longer ear as a pivot point to thereby rotate said rounded end and the shorter ear through said bore and said slot.

21. The pulley block system of claim 19 wherein:

said web portion lies in a plane containing one of said side portions of said second pulley block assembly.

22. The pulley block system of claim 15 wherein:

said first pulley block assembly includes a web portion lying in a plane parallel to and between said side portions of said first pulley block assembly and containing a bore therethrough by means of which the free end of a line to be reeved through said first and second pulley rollers can be attached to said first pulley block assembly.

* * * * *